US007177567B2

(12) United States Patent
Miller

(10) Patent No.: US 7,177,567 B2
(45) Date of Patent: Feb. 13, 2007

(54) INTEGRATED TONER CARTRIDGE WITH TONER AGITATOR AND SENSING DEVICE

(76) Inventor: Steven Miller, 3750-A Airport Blvd., Unit 141, Mobile, AL (US) 36608

( * ) Notice: Subject to any disclaimer, the term of this patent is extended or adjusted under 35 U.S.C. 154(b) by 10 days.

(21) Appl. No.: 10/907,470

(22) Filed: Apr. 1, 2005

(65) Prior Publication Data

US 2005/0163530 A1 Jul. 28, 2005

Related U.S. Application Data

(63) Continuation of application No. 10/742,323, filed on Dec. 19, 2003.

(60) Provisional application No. 60/521,326, filed on Apr. 1, 2004.

(51) Int. Cl.
*G03G 21/18* (2006.01)
*G03G 15/08* (2006.01)
*G03G 15/00* (2006.01)

(52) U.S. Cl. ..... 399/113; 399/12; 399/27; 399/263

(58) Field of Classification Search ..... 235/461; 399/12, 24, 27, 119, 120, 113, 262, 263
See application file for complete search history.

(56) References Cited

U.S. PATENT DOCUMENTS 6,246,841 B1 6/2001 Merrifield et al.
6,397,015 B2 * 5/2002 Curry et al. ..... 399/12
6,771,922 B2 8/2004 Blanck et al.

* cited by examiner

*Primary Examiner*—Hoang Ngo
(74) *Attorney, Agent, or Firm*—Thomas E. Toner; Smith & Hopen, P.A.

(57) ABSTRACT

A toner cartridge with a uni-body construction reduces the cost of production as well as reducing the chance of failure during use. The toner cartridge includes a waste bin having a leading end that can be sculpted to mate with the cartridge-receiving cavities of a large number of printers. Additional improvements include an improved toner beater and sensing apparatus, the elimination of a pivotal motion between the elements of the cartridge, an enhanced method of determining the amount of toner remaining in the toner chamber, and an improved means of agitating the toner within the toner chamber.

9 Claims, 19 Drawing Sheets

INTEGRATED TONER CARTRIDGE WITH TONER AGITATOR AND SENSING DEVICE

CROSS REFERENCE TO RELATED APPLICATIONS

This application claims priority to U.S. Provisional Patent Application No. 60/521,326, entitled, "Total Cartridge," filed Apr. 1, 2004 and co-pending U.S. patent application Ser. No. 10/742,323 entitled "Removable Toner Cartridge Universal Adapter," filed Dec. 19, 2003 which are fully incorporated herein by reference.

BACKGROUND OF THE INVENTION

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the image transfer drum. The toner is transferred to paper, or other medium, as it passes over the rotating image transfer drum. Subsequently, the paper is heated so that the plastic is melted thereby permanently affixing the ink to the paper.

The vast majority of commercially available desktop laser printers include replaceable or removeable toner cartridges that incorporate an image transfer drum, a toner tank, and a metering system. A drive mechanism is connected to the drum and metering system. Modern toner cartridges often include a variety of sensors that interact with the laser printer to indicate the status of the cartridge. Indications relating to toner level, print quality and general cartridge function are often included as well. A large number of types and sizes of toner cartridges are currently available. The sensing system typically includes an encoder wheel interconnected with a rotating agitating paddle within a cylindrical toner tank. Movement of the agitating paddle feeds toner into the metering system. The encoder wheel reports the movement of the agitating paddle wheel through the toner reservoir.

Previously, certain printers in the electro-photography industry have only been able to receive a toner cartridge consisting of two assemblies, a hopper and a waste bin. This dual assembly requires that the respective parts be held together with an attaching bias, such as springs. The attaching bias may fail, rendering the cartridge apparatus inoperable. Therefore, what is needed is a complete, or uni-body, and non-removable toner cartridge that integrates the hopper and the waste bin into a single unit, thereby eliminating the potential of failure inherit in the printers of the prior art.

SUMMARY OF INVENTION

The long-standing but heretofore unfulfilled need for a toner cartridge that is adapted to be of an integrated construction, thereby limiting the number of elements required during manufacture, and which also includes improvements that overcome the limitations of prior art toner cartridges is now met by a new, useful, and non-obvious invention.

The novel toner cartridge includes a waste bin at the leading end of the toner cartridge. A main body connects to the waste bin at a trailing end of the waste bin. The waste bin and main body are fixedly interconnected to one another and are held against movement relative to one another when fully installed within said toner cartridge receiving cavity. A rear housing connects to the main body at the trailing end of the main body thereby defining a toner chamber therein. The rear housing and main body are fixedly interconnected to one another and being held against movement relative to one another when manufactured. This construction creates a unibody cartridge with fewer connecting parts and no pivotal joints which, as in the prior art, can fail.

In an alternate embodiment, the waste bin includes a leading end sculpted to mate with the cartridge receiving cavity of a plurality of printers. The waste bin connects to the main body by fasteners chosen from the group consisting of adhesives, dovetail joinery, and mechanical fasteners.

In another embodiment, the novel toner cartridge includes a toner beater and sensing device for use in a toner cartridge having a toner chamber including a primary shaft rotatable in the toner chamber having a plurality of support members protruding radially from the primary shaft. A sensing device pivotally connects to the primary shaft such that the sensing device rotates within the toner chamber in the same path of travel as, and in leading relation to, the support members. An encoder disk connects to one end of the primary shaft connected to the sensing device, such that the rotation of the sensing device coincides with the rotation of the encoder disk. A gear is disposed at one end of the primary shaft such that rotation of the gear causes the primary shaft to rotate within the toner chamber.

The toner beater and sensing device include a biasing means attached to the encoder disk and primary shaft such that the sensing device is selectively forced, when no resistance is exerted upon thereon, into leading relation to the support members as the primary shaft rotates. Adjacent to the gear, the toner beater and sensing device includes a spiral support material disposed along one of the primary shaft adjacent to the gear such that toner is urged from the perimeter of the toner chamber toward the center of the chamber.

In alternate embodiments, encoder disk further includes a plurality of indicia capable of detection by a printer such that detection thereof indicates the level of toner in the toner chamber. The encoder disk further includes a plurality of blades across its outer surface such that rotation of the encoder disk causes particulate matter to be blown away from the encoder disk thus cleaning the light sensor in the printer.

In one embodiment, the gear connected to the primary shaft is a ratcheting gear. In a general embodiment, the ratcheting gear includes a plurality of ratcheting detents radially oriented within the inner surface of the ratcheting gear. A gear disk is rotatably disposed within the ratcheting gear, equipped with a plurality of pawls adapted to be received by the detents of the ratcheting gear such that the ratcheting gear will rotate about the gear disk when the resistance on the primary shaft exceeds the force applied by the rotation of the ratcheting gear.

Also provided is a method of sensing the amount of toner in a toner cartridge having a toner chamber by providing a primary shaft that plurality of support members that protruding radially from the primary shaft. A sensing device is pivotally connected to the primary shaft such that the sensing device rotates within the toner chamber in the same path of travel as, and in leading relation to, the support members. An encoder disk disposed at one end of the primary shaft connected to the sensing device, such that the rotation of the sensing device is conjoint with the rotation of the encoder disk. As the mechanism rotates through the toner chamber, the sensing device comes into contact with the toner where it stops until support structures of primary driving shaft engage it and drive it through the toner. When the toner sensing device emerges from the body of toner it springs forward and the cycle begins again. A number of indicia established on the encoder disk are detected by a light source within the printer. A toner usage algorithm is defined based on the position of the indicia on the encoder disk, as detected by the light source within the printer, when the sensing device contacts the toner. The amount of toner estimated to be remaining within the toner chamber is communicated to the user by the interface provided by the printer software.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum on which an electrostatic image is formed. The photoconductive drum rotates in a plane perpendicular to that of the print medium passing through the toner cartridge. A recovery blade is placed in direct contact with the photoconductive drum. During the imaging stage, the photoconductive drum is exposed to light, usually a laser, which imprints a latent image thereon. A developing roller converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

Construction of the Novel Toner Cartridge

Figure 1:
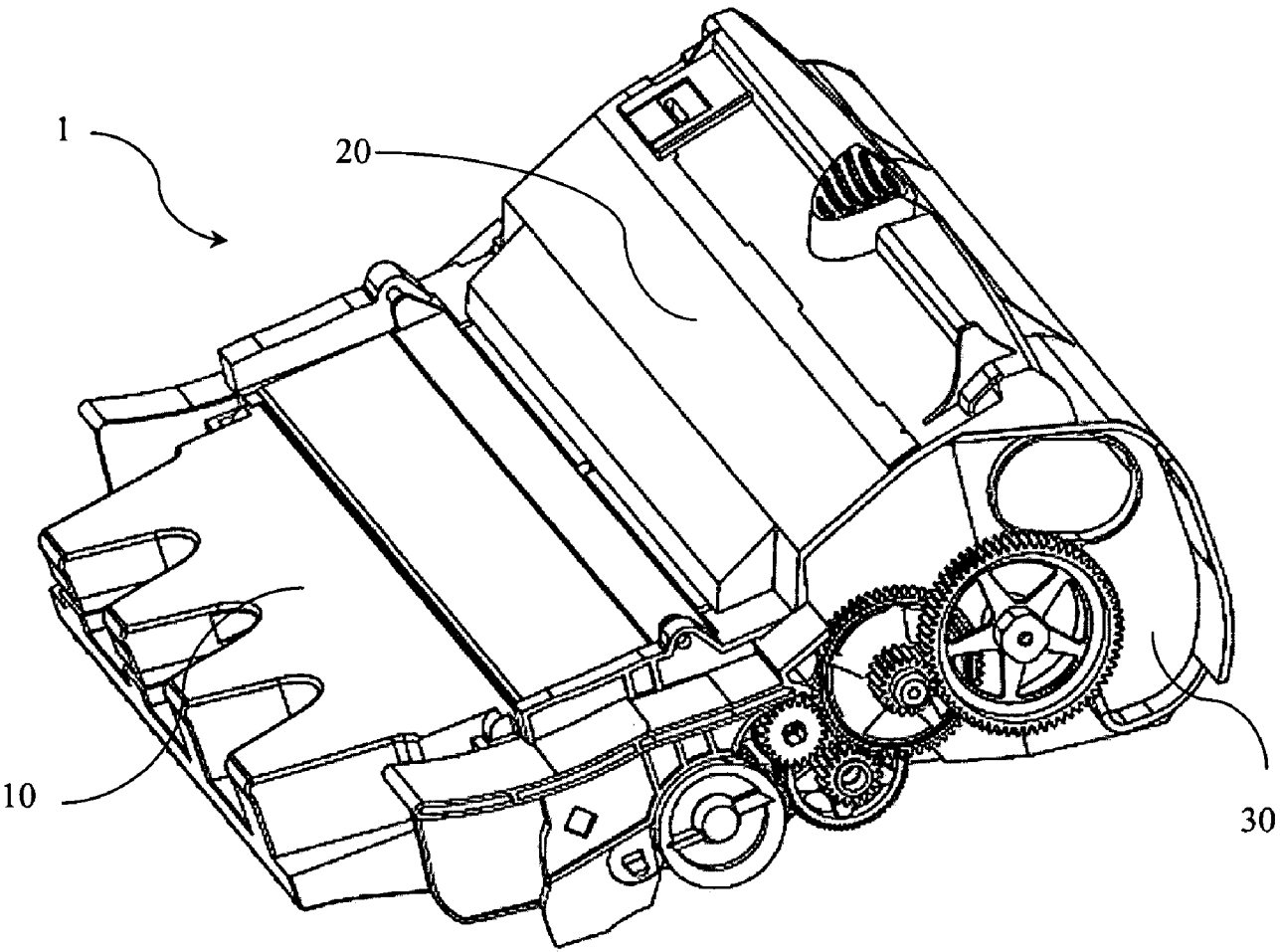
FIG. 1 is a perspective view of the novel toner cartridge.
Figure 2:
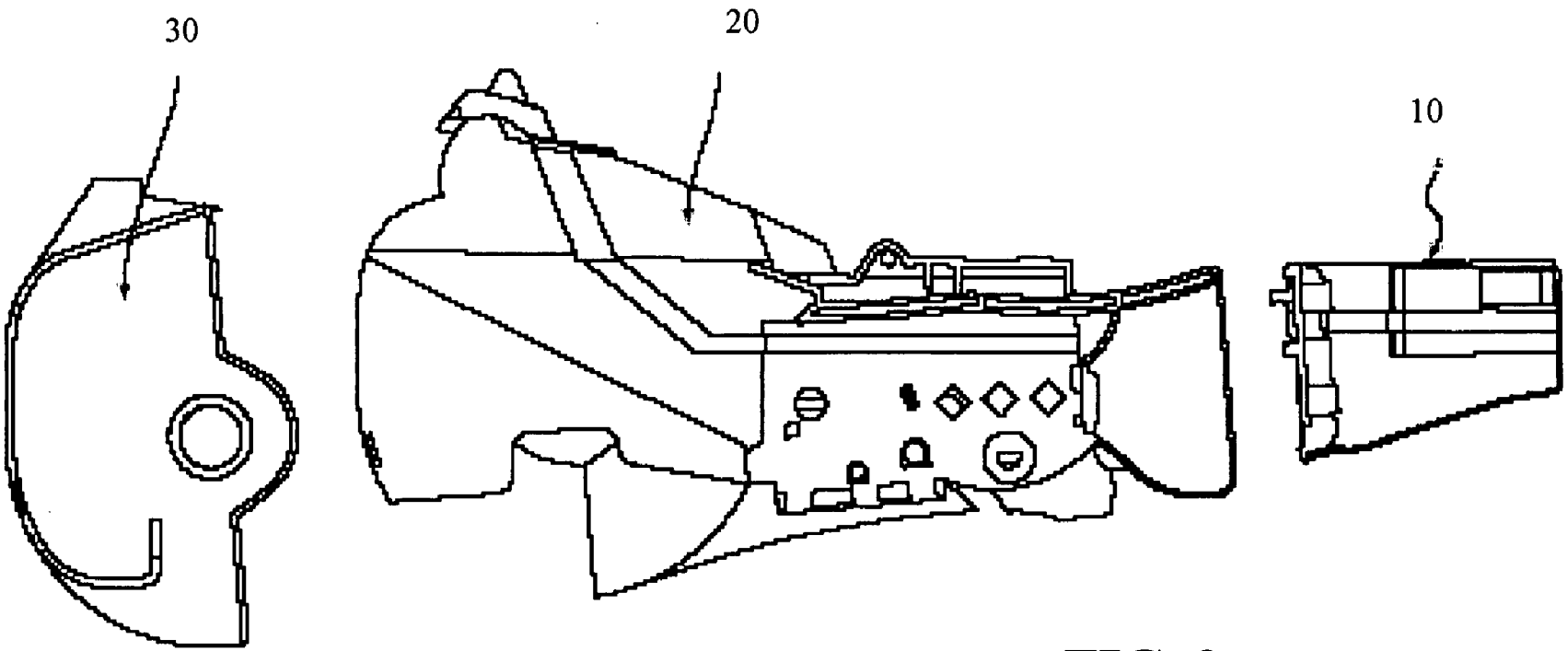
FIG. 2 is an exploded perspective view of the novel toner cartridge.
Figure 3:
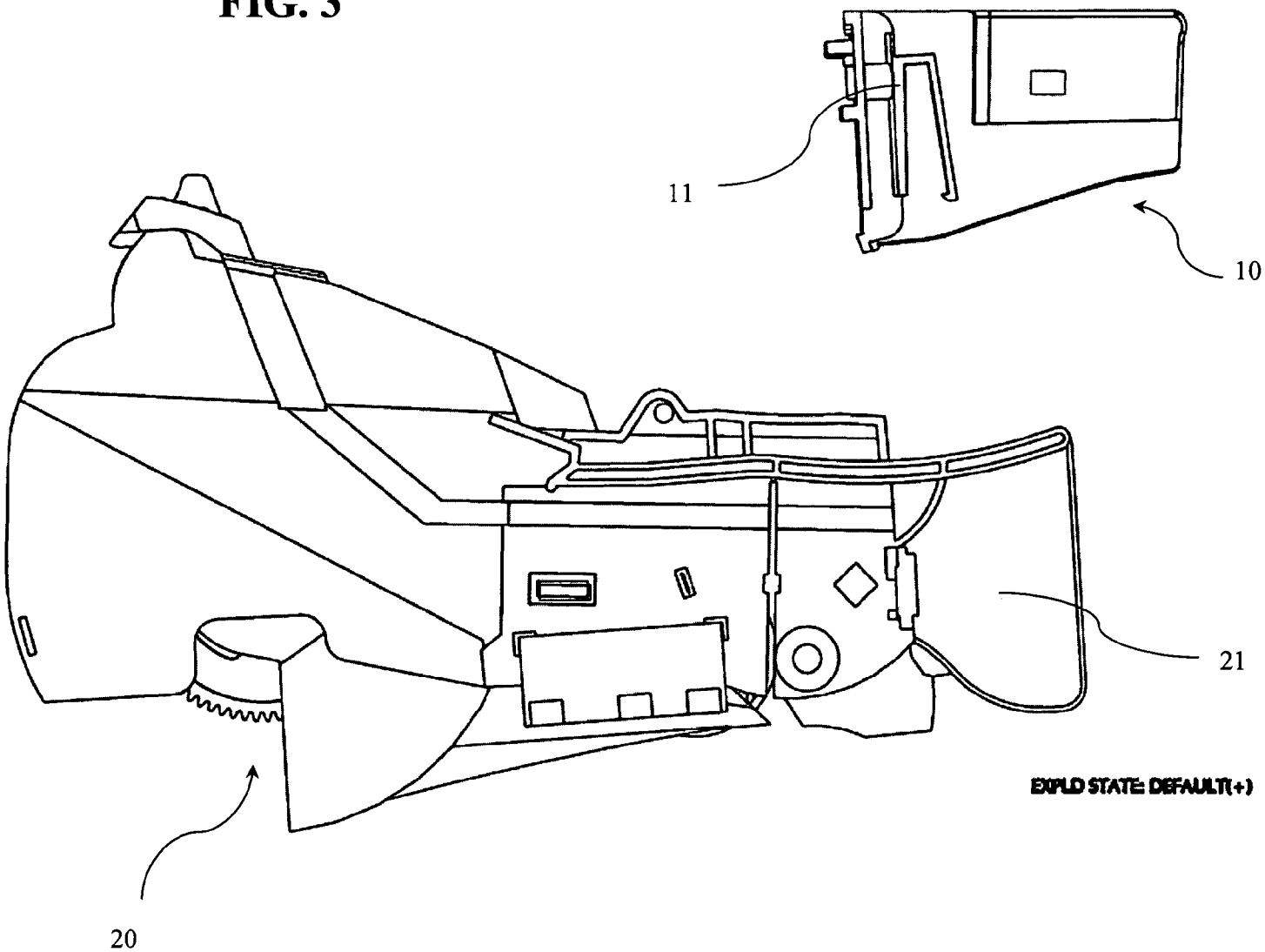
FIG. 3 is an exploded perspective view of the novel toner cartridge.
Figure 4:
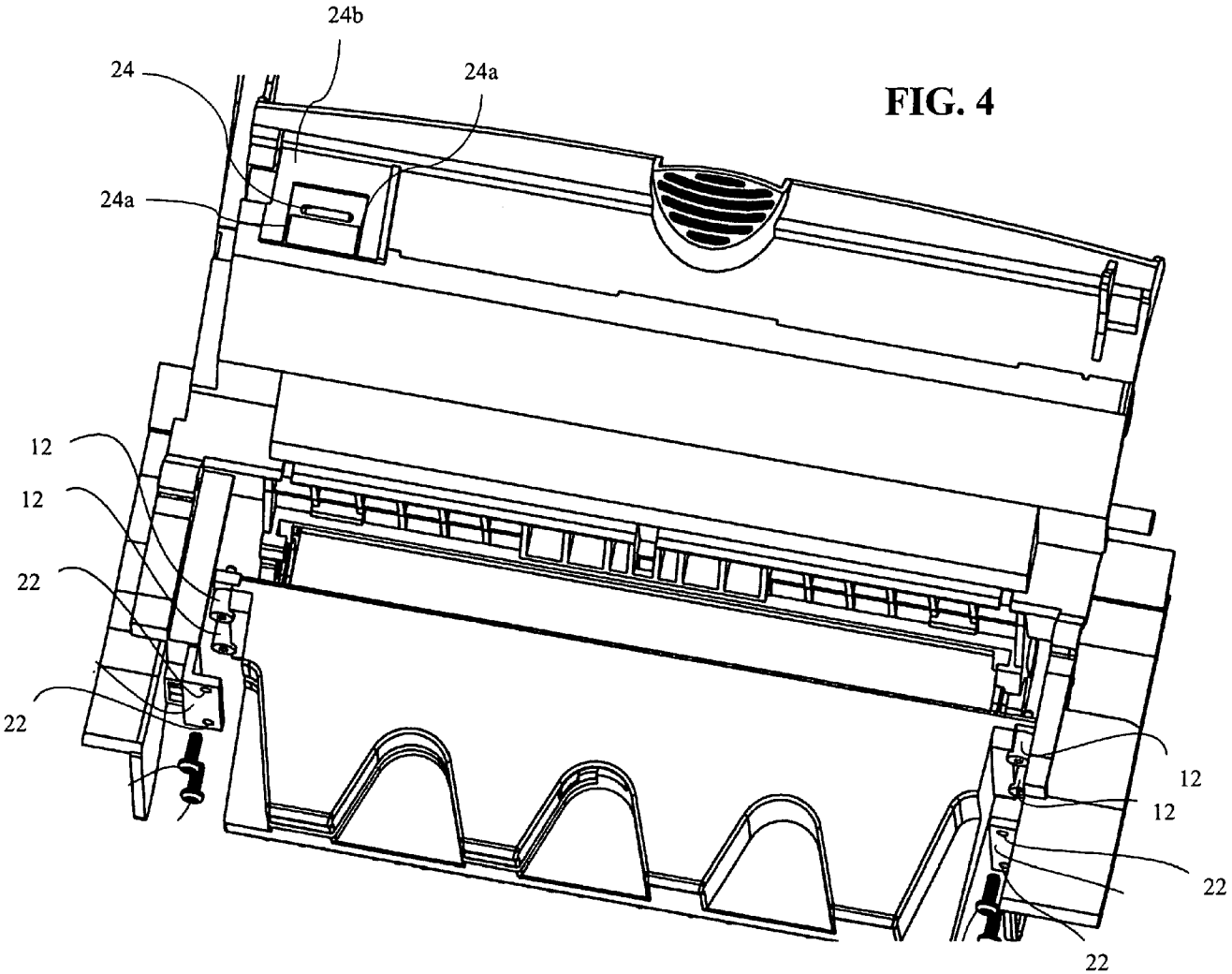
FIG. 4 is a top perspective view of the novel toner cartridge showing one means of fastening the waste bin to the main body.
Figure 4A:
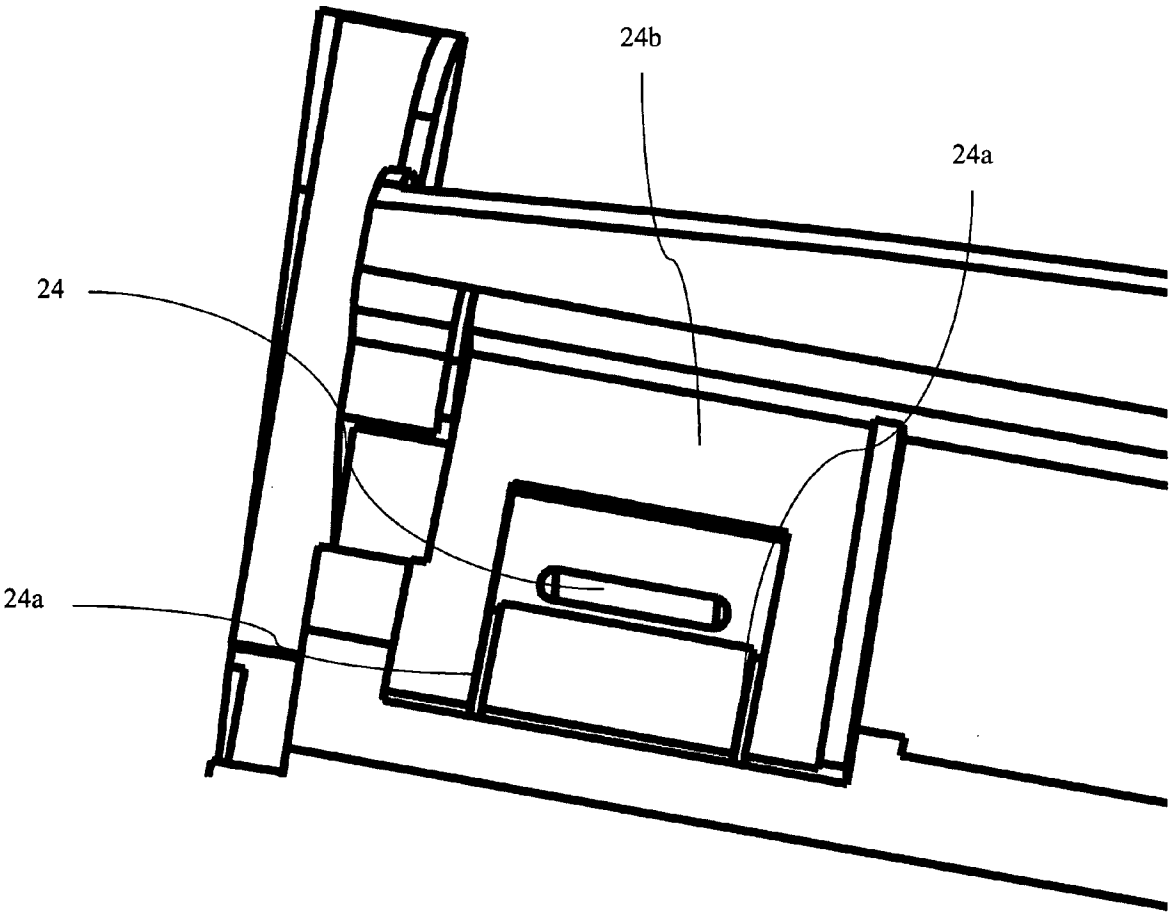
FIG. 4A is a close-up top perspective view of the vent apparatus disposed within the main body.
Figure 5:
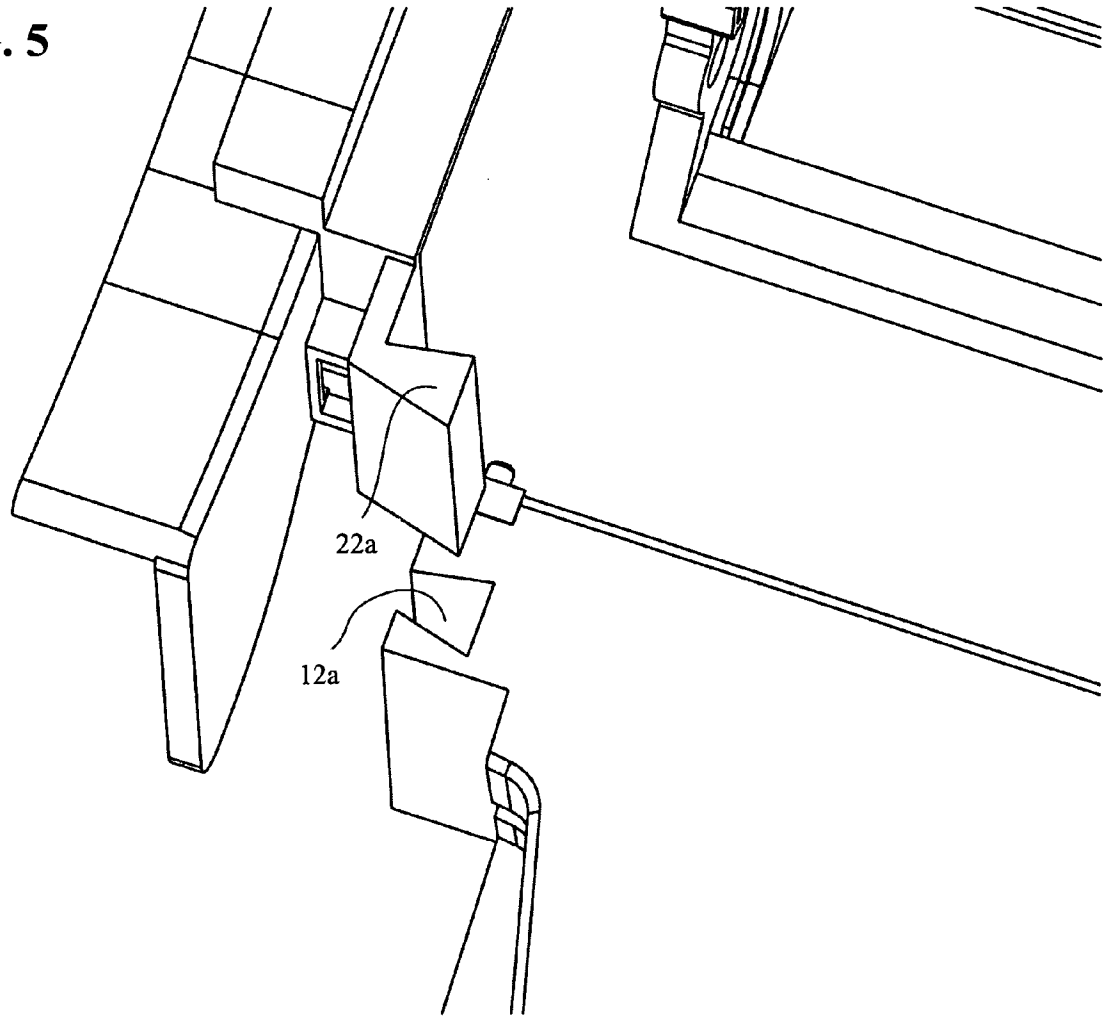
FIG. 5 is an exploded perspective view of the novel toner cartridge showing an alternate means of fastening the waste bin to the main body.

Referring now to FIGS. 1 and 2, it will be seen that the reference numeral 1 denotes an illustrative embodiment of the novel toner cartridge as a whole. Novel toner cartridge 1 is made by interconnecting waste bin 10 and rear housing 30 to main body 20. Specifically, as suggested by the alignment of parts in FIG. 3, trailing end of waste bin 10 is connected to the leading end of main body 20. In similar fashion, the leading end of toner reservoir 30 is connected to the trailing end of main body 20 (FIG. 2). FIGS. 4 and 5 illustrate possible methods of connecting waste bin 10 with main body 20. In one embodiment (FIG. 3) waste bin 10 is positioned over the leading end of main body 20 and then lowered until the two parts are interconnected via correlating connecting mechanisms 11 located on waste bin 10 and the leading end of main body 21. Illustrative embodiments of how waste bin 10 is connected to main body 20 are disclosed more fully herein.

Waste Bin: The waste bin is attached to the main body either permanently or by releasable means, for the purposes of maintenance. When mechanical fasteners are employed, the fasteners, FIG. 4, are located in predetermined locations such as by way of precisely positioned screw-bosses 12 located on waste bin 10, that mate with holes 22 formed in receiving tabs on main body 20. An alternative attachment method, FIG. 5, is achieved by means of an integral fastener received by a flared receiving channel 12*a*, much like a dove-tail joint, on waste bin 10 that accepts a pin 22*a*, on main body 20 by way of a sliding action whereby the pin and channel interlock. The wiper blade and the recovery blade are integrated with the front section.

Figure 6:
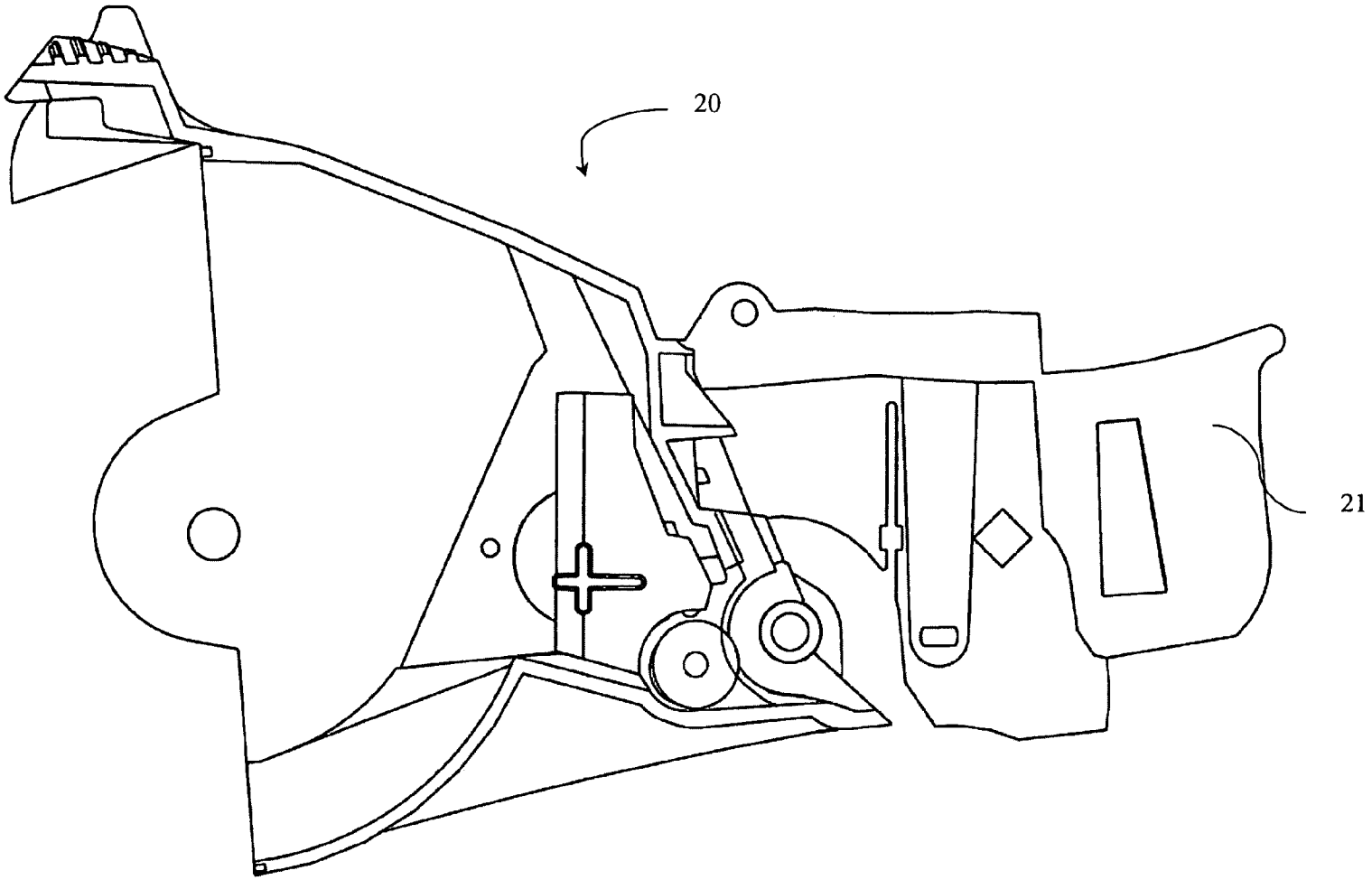
FIG. 6 is a side elevational view of the main body of the novel toner cartridge.

Main Body: FIG. 6 shows the construction of main body 20 independent of waste bin 10 and rear housing 30. Main body 20 houses the doctor bar & spring, developer roller, toner adder roller, photoconductive drum, sealing members and a toner sifter (not shown). At its leading end, main body 20 has two extensions 21 at its lateral ends adapted to receive waste bin 10 (as discussed supra). Doctor bar & spring, developer roller, toner adder roller, photoconductive drum, sealing members and a toner sifter (not shown) are located between extensions 21 and in trailing relation to waste bin 10.

Figure 7:
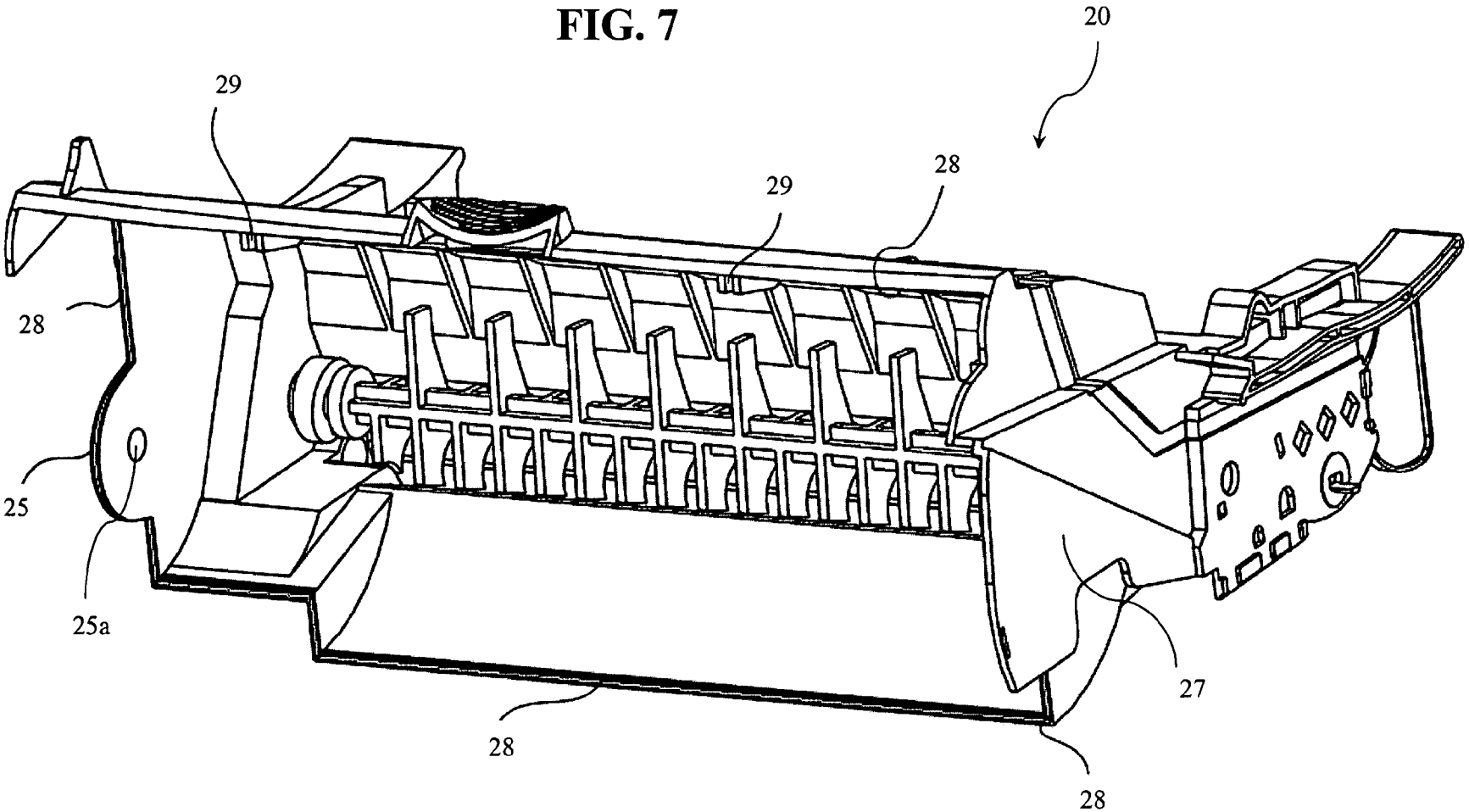
FIG. 7 is a rear perspective view of the main body of the novel toner cartridge.

As depicted in FIG. 7, the trailing end of main body 20 is open, defining a space between the lateral walls thereof. On one end of main body 20 the side wall extends outward to form a male-connection point 25 which is received by rear housing 30, as discussed below. An opening 25*a* is disposed within male-connection point 25 through which extends the primary shaft of the beater/sensing device (discussed below) to communicate with the gear which drives the toner beater sensing device.

The adjacent side wall is adapted with a semi-circular inward recess defining a female-connection point 26 to receive a corresponding male-connection point on rear housing 30. Protective cover 27 is disposed adjacent to the side wall comprising female-connection point 26 to prevent external forces, while in use or in storage, from causing damage to the moving parts of the toner cartridge. Protective cover 27 also provides a contact point for a pin (73, FIG. 13) located on the encoder disk, opposite the gear which drives the rotation thereof. This contact point prevents lateral movement of the encoder disk during operation.

Main body 20 is equipped with vent 24 (see FIG. 4). Vent 24 permits air to enter the toner chamber as toner is expelled, thus facilitating the flow of toner. Without vent 24, a vacuum would be created within the toner cartridge and the resulting external pressure would prevent toner from being applied. A filtration material, such as felt, is placed over vent 24 to prevent toner from escaping through vent 24. The filter material must be sufficiently permeable to allow air to pass into the toner chamber, while sufficiently impermeable to prevent the escape of toner. Air channels 24*a* allow air to flow to vent 24 when a circuit board or retaining material is placed over circuit board-receptacle 24*b*.

Figure 8:
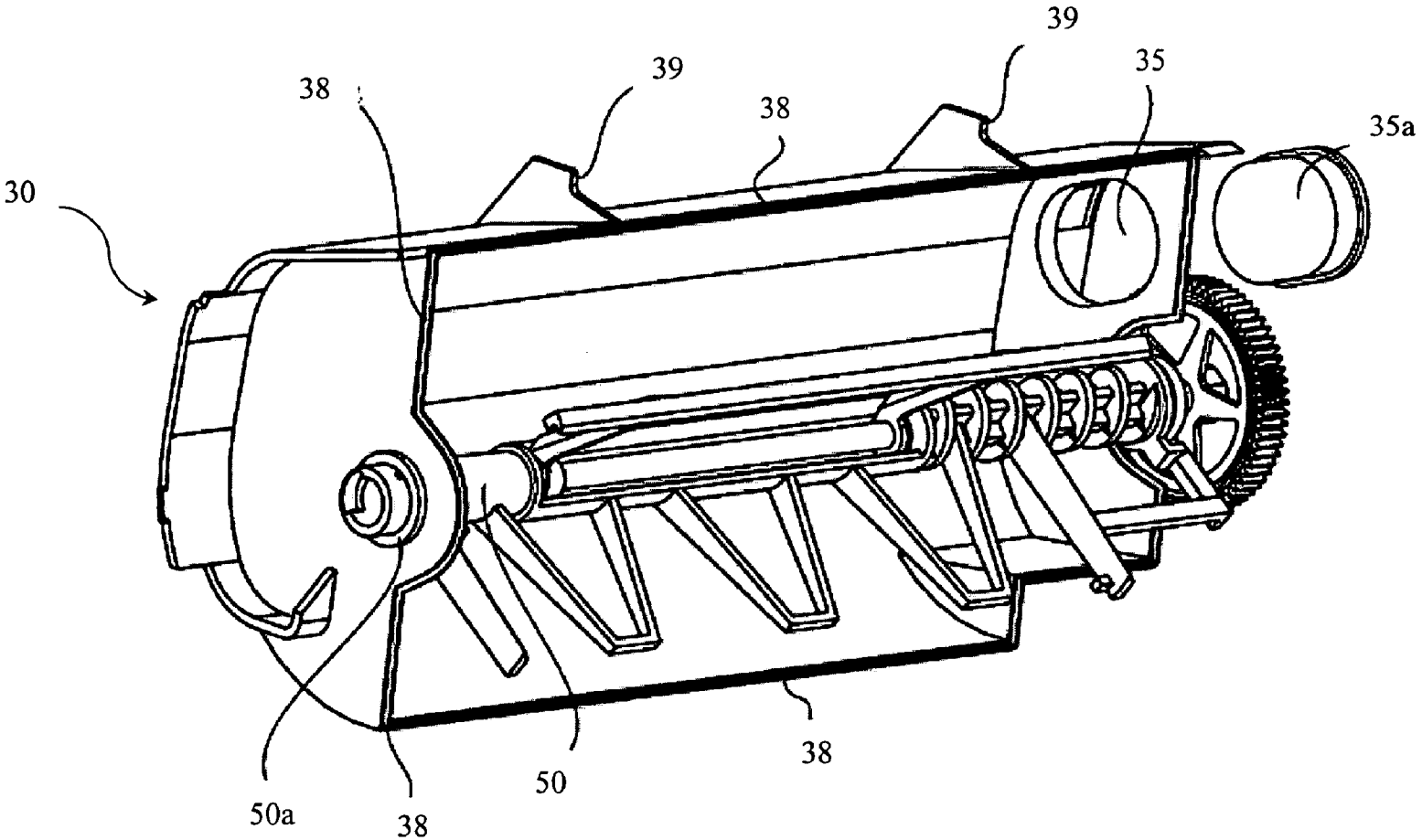
FIG. 8 is a front perspective view of the rear housing and oval plug of the novel toner cartridge.

Toner chamber: As shown in FIG. 8, the leading edge of rear housing 30 has a perimeter of a connecting surface 38 in the fashion of a tongue-and-groove, to mate with a corresponding connecting surface 28 of main body 20 (FIG. 7). Rear housing 30 includes vertical tabs 39 formed on its upper surface that engage slots 29 formed on main body 20 (FIG. 7). Rear housing 30 can be adhered to main body 20 by any means known in the art. Illustrative examples include, but are not limited to, adhesives, welding, and mechanical fasteners.

When rear housing 30 is mated with main body 20, a toner chamber is defined by the cavity formed therein. Toner is discharged from a lower portion of main body 20 and supplied to the toner-adder roller. The toner chamber holds fresh, unused toner and houses the beater and sensing device. The toner beater and sensing device extend from the primary drive shaft. The primary drive shaft is rotatably supported and driven, through a gear train, by a drive element in the laser printer. The toner beater and sensing device agitate the toner, thus preventing the toner from becoming compacted. In this manner, the toner is kept sufficiently fluid to be discharged uniformly from main body 20.

Fill-hole 35 is disposed within the side wall of rear housing 30 (FIG. 8). Fill-hole 35 is preferably oval shaped, thus allowing air to escape the toner chamber as toner is funneled into the toner chamber. Fill-cap 35*a* is inserted into fill-hole 35 so toner cannot escape there through. In one embodiment fill-cap 35*a* is releasably placed within fill-hole 35 so the cartridge can be recycled and re-filled.

Figure 9:
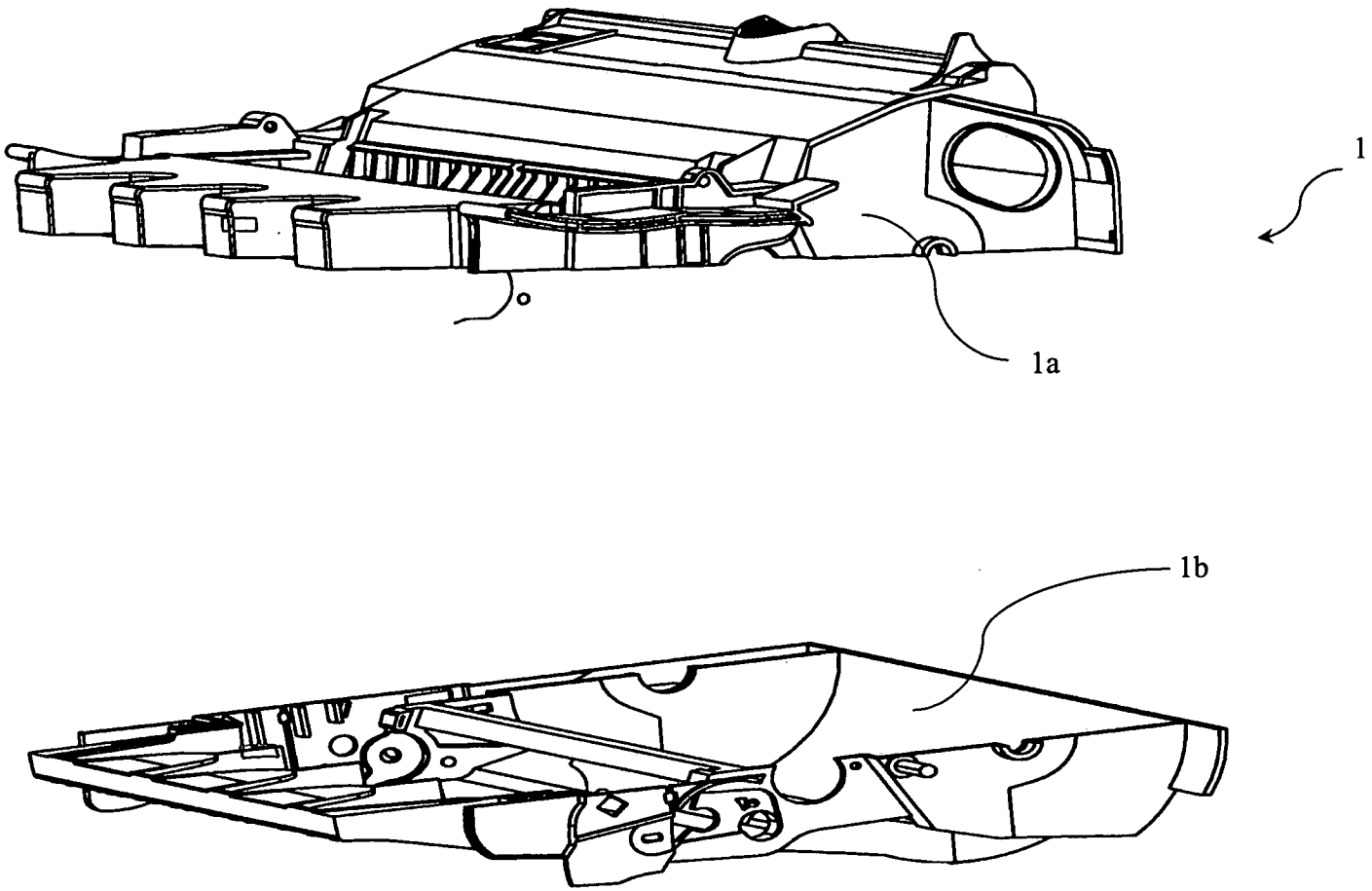
FIG. 9 is a perspective view of an alternative construction configuration of the novel toner cartridge.

Alternatively, the novel toner cartridge can be manufactured using two halves which are adhered together. For example, FIG. 9 shows an alternate construction method of toner cartridge 1 wherein top portion 1*a* is adhered to bottom portion 1*b*. It is also contemplated that similar construction can be achieved using a left and right portion adhered along their longitudinal access. This construction also permits the addition of the elements necessary for operation (photoconductive drum, beater, toner adder roller, etc.).

Beater and Sensing Device

Figure 10:
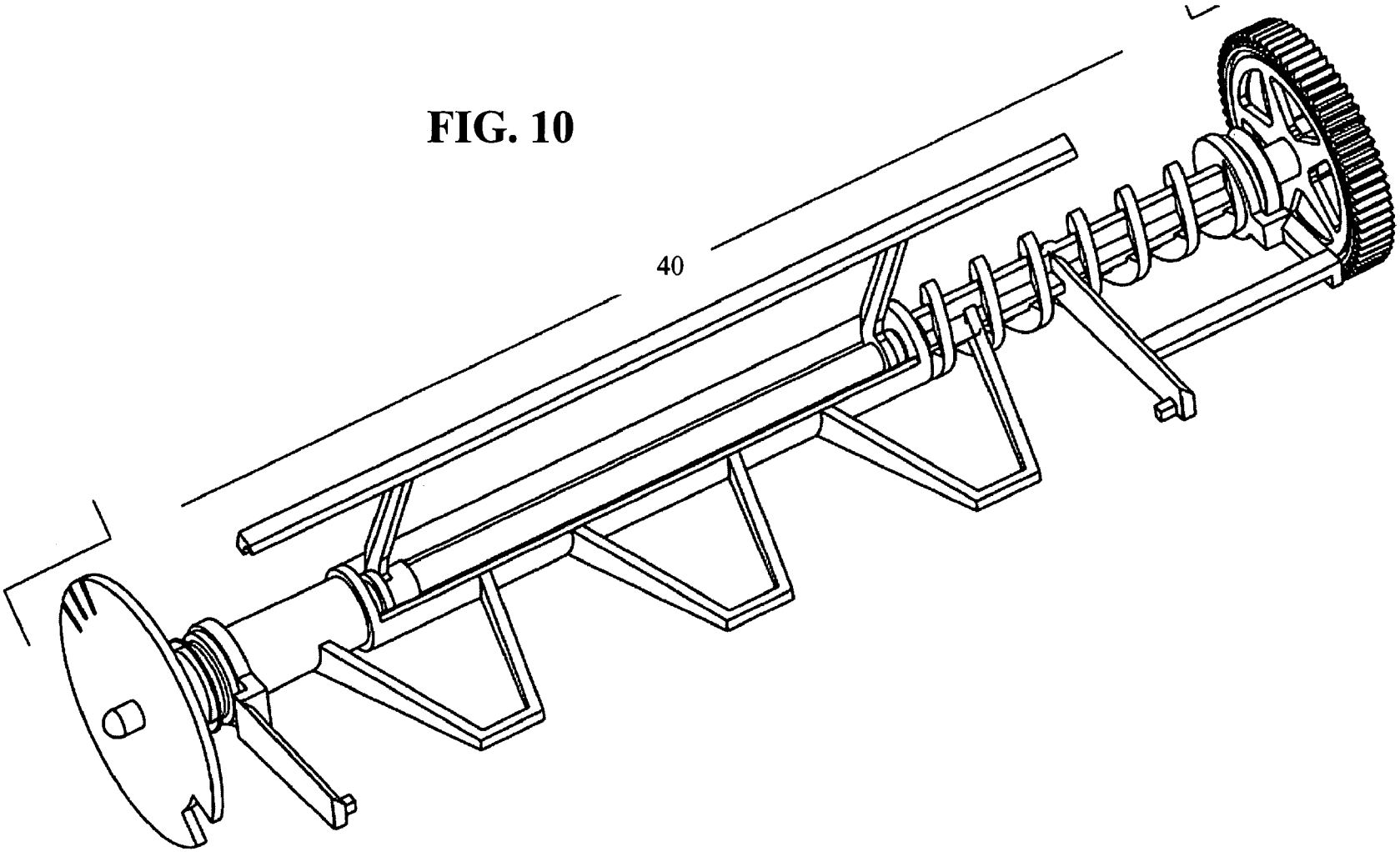
FIG. 10 is a perspective view of the toner beater and sensing device of the novel toner cartridge.
Figure 11:
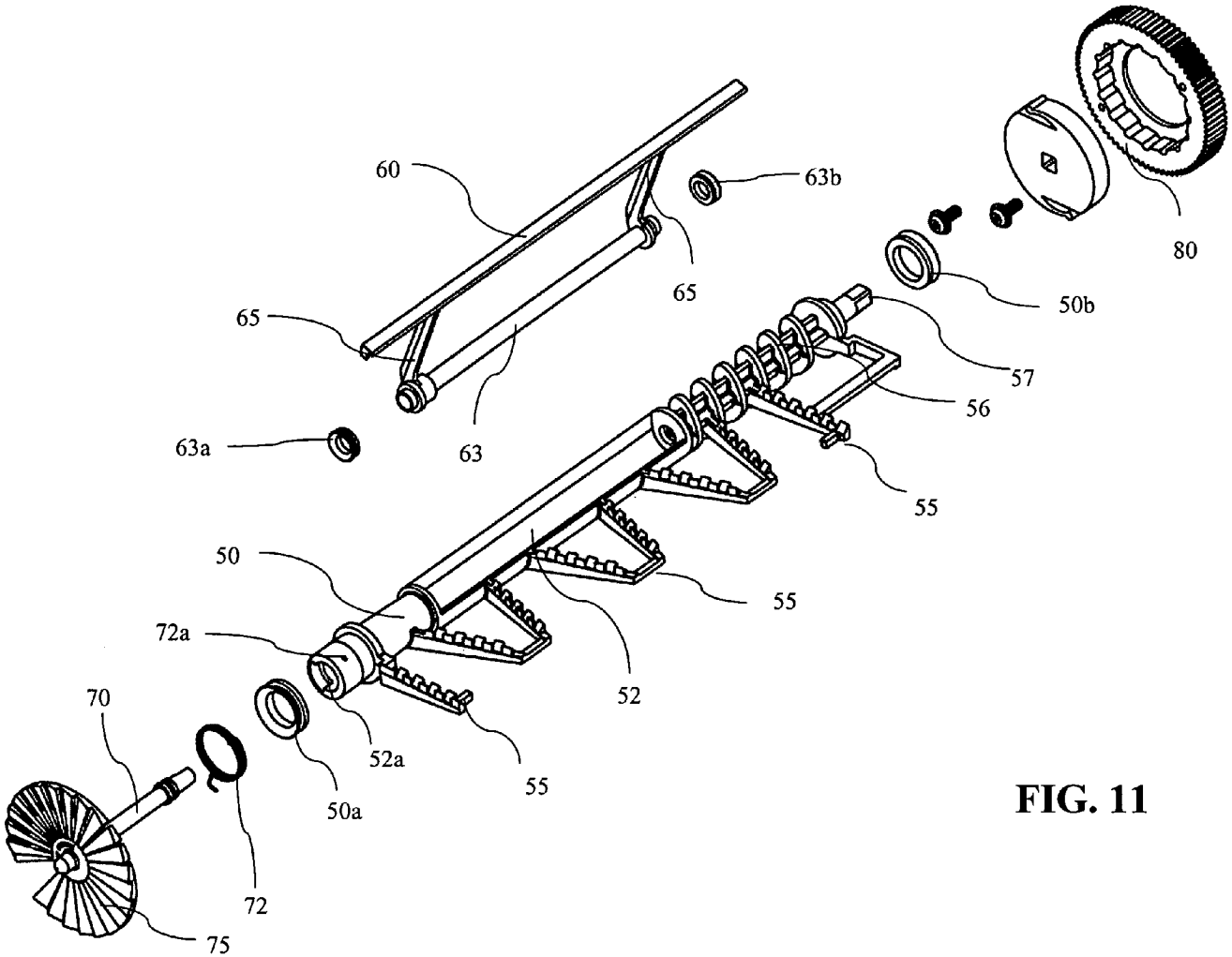
FIG. 11 is an exploded perspective view of he toner beater and sensing device of the novel toner cartridge.

One embodiment of the inventive apparatus includes a shaft assembly, denoted as whole by reference numeral 40 in FIG. 10, comprising, generally, a primary drive shaft 50, having a cored-out region 52 (FIG. 11) which provides a point of connection for a toner sensing device 60. Primary shaft 50 further comprises a plurality of protruding support-members 55, spiraling support material 56 and axle 57 upon which is mounted gear 80 for conjoint rotation therewith (FIG. 11).

Toner sensing device 60 is pivotally connected to primary drive shaft 50. The range of motion of sensing device 60 is between zero (0) degrees (direct contact) and an angle not to exceed one hundred eighty (180) degrees with respect to protruding support members 55 affixed to primary shaft 50 (see FIG. 18). When sensing device 60 is oriented at zero (0) degrees, with relation to support members 55, it is in its position of engagement. When sensing device 60 is oriented at its greatest distance from support members 55, it is in its position of repose.

In one embodiment, toner sensing device 60 comprises a sensing device shaft 63 which resides within a cored out region 52 of primary shaft 50. In this embodiment, sensing device 60 is spaced away from primary shaft 50 by extension arms 65. In this manner sensing device 60 moves in an arcuate path of travel in relation to both primary shaft 50 and sensing device shaft 63. The range of motion of sensing device 60 is between zero (0) degrees (engagement) and an angle not to exceed one hundred eighty (180) degrees with respect to protruding support members 55 affixed to primary shaft 50 (repose) (see FIG. 18).

Opposite of gear axle 57, primary shaft 50 is hollow 52*a* to enable insertion of encoder axle 70 into primary shaft 50 at hollow end 52*a* and thereby extend into cored-out region 52. Encoder axle 70 thereby engages sensing device shaft 63 causing sensing device 60 to rotate as force is exerted on encoder axle 70. Accordingly, encoder axle 70, and therefore sensing device shaft 63, rotate independently of primary shaft 50 when the disposition of sensing device 60 is between zero (0) degrees (direct contact) and an angle not to exceed one hundred eighty (180) degrees with respect to protruding support members 55 affixed to primary shaft 50 (see FIG. 11).

Biasing means 72, such as a spring, engages encoder disk 75 and primary shaft 50, preferably at a point along shaft 50 which is outside the body of the completed cartridge, such as point 72*a*. Biasing means 72 applies sufficient rotational force to encoder axle 70 (and thereby on sensing device shaft 63) to extend sensing device 60 to its point of repose, not greater than one hundred eighty (180) degrees from protruding support members 55 when no resistance, i.e. no toner, is exerted against sensing device 60.

Accordingly, gear 80 provides the rotational force for primary shaft 50 at all times and for toner sensing device 60 when toner sensing device 60 is at its point of repose, or its minimal distance, engagement. Biasing means 72 provides rotational force for sensing device 60 when sensing device 60 is between its minimum and maximum extension range.

Conforming seals are used to prevent toner from leaking from the toner chamber. Two seals 63*a*, 63*b* are placed on the ends of sensing device shaft 63 at its distal ends. Conforming seal 63*a* is disposed at the distal end of sensing device shaft 63 where it abuts inner surface of cored-out region 52. In this manner, toner is prevented from traveling through the hollow section 52*a* of primary shaft 50 and out of the toner chamber. Seal 63*b* prevents toner from infiltrating the contact space between sensing device shaft 63 and cored-out region 52 opposite encoder axle 70, which could cause binding of sensing device shaft 63 thus interfering with its pivoting action. Conforming seals 50*a* and 50*b* insulate the distal ends of primary shaft 50 to prevent toner from escaping the chamber.

Figure 12:
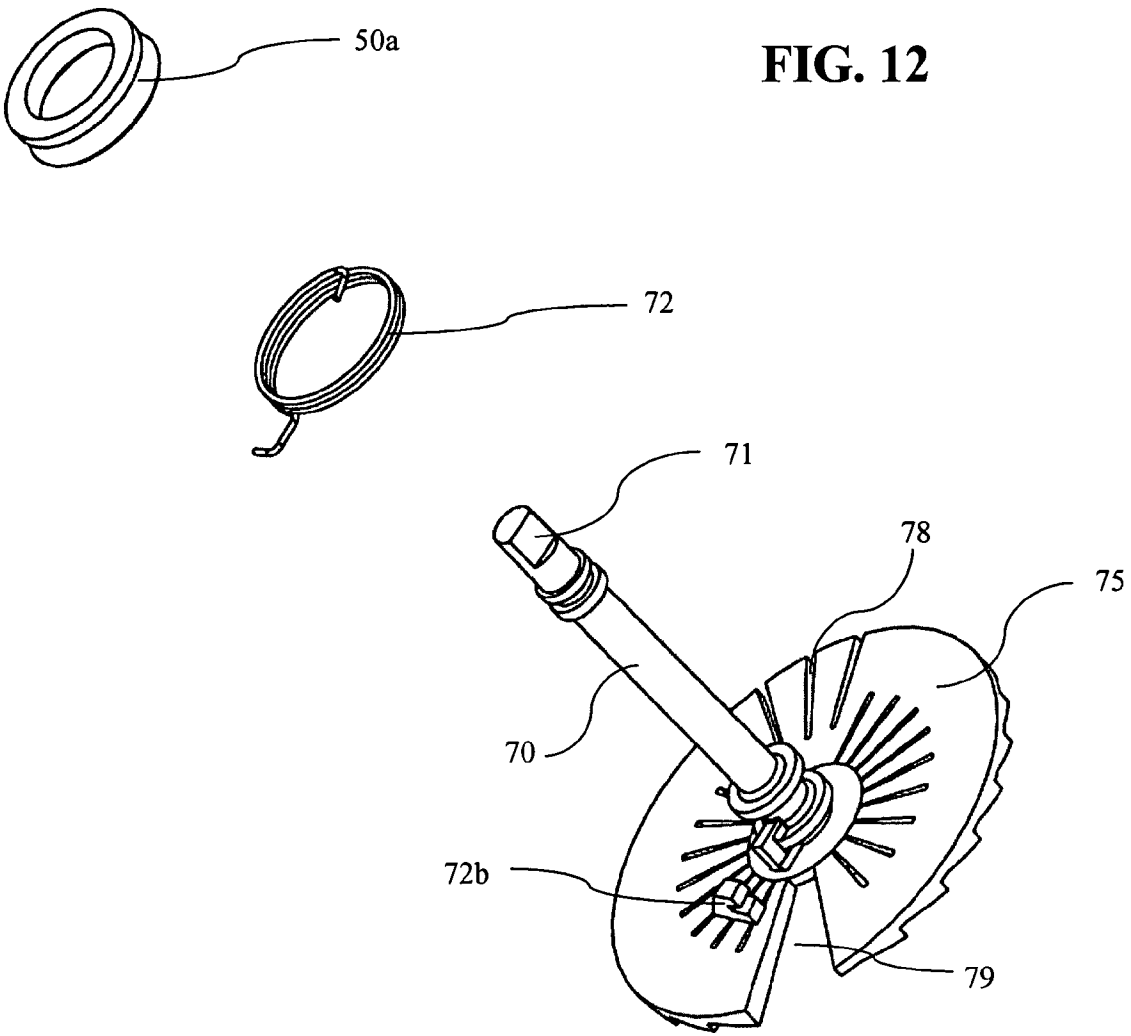
FIG. 12 is an exploded perspective view of the encoder disk and biasing means.

FIG. 12 shows a detail construction of encoder disk 75 in one embodiment of the inventive apparatus. Biasing means 72 connects to encoder wheel 75 at point 72*b*. The opposite end of biasing means 72 attaches to primary shaft 50 at point 72*a* as discussed supra. The end of encoder axle 70 is provided with a contact surface 71 which engages sensing device shaft 63. In this manner, the force exerted on encoder axle 70 by biasing means 72 transfers to sensing device shaft 63 causing it to rotate if the force exceeds the resistance.

Toner level indicia 78 can be disposed along any radius of encoder disk 75. In operation a detecting source, usually a beam of light, is projected against encoding disk 75. When the disk rotates so as to expose indicia 78 to the beam, the light passes through encoding disk 75 to a sensor which tells the printer the level of toner. Window 79 is disposed within encoder disk 75 to serve as a reference point for the toner level sensor of the printer. Any number of indicia can be used, as will be appreciated by one skilled in the art.

When the printer starts its initialization sequence, a light sensitive sensor in the printer identifies the position of window 79 and relays a signal to the intelligence in the host printer which references the position of the window as the home position. The home position is necessary for the printer to complete the initialization sequence. An error signal is generated when the home position cannot be determined, thus disabling operation of the printer.

Figure 13:
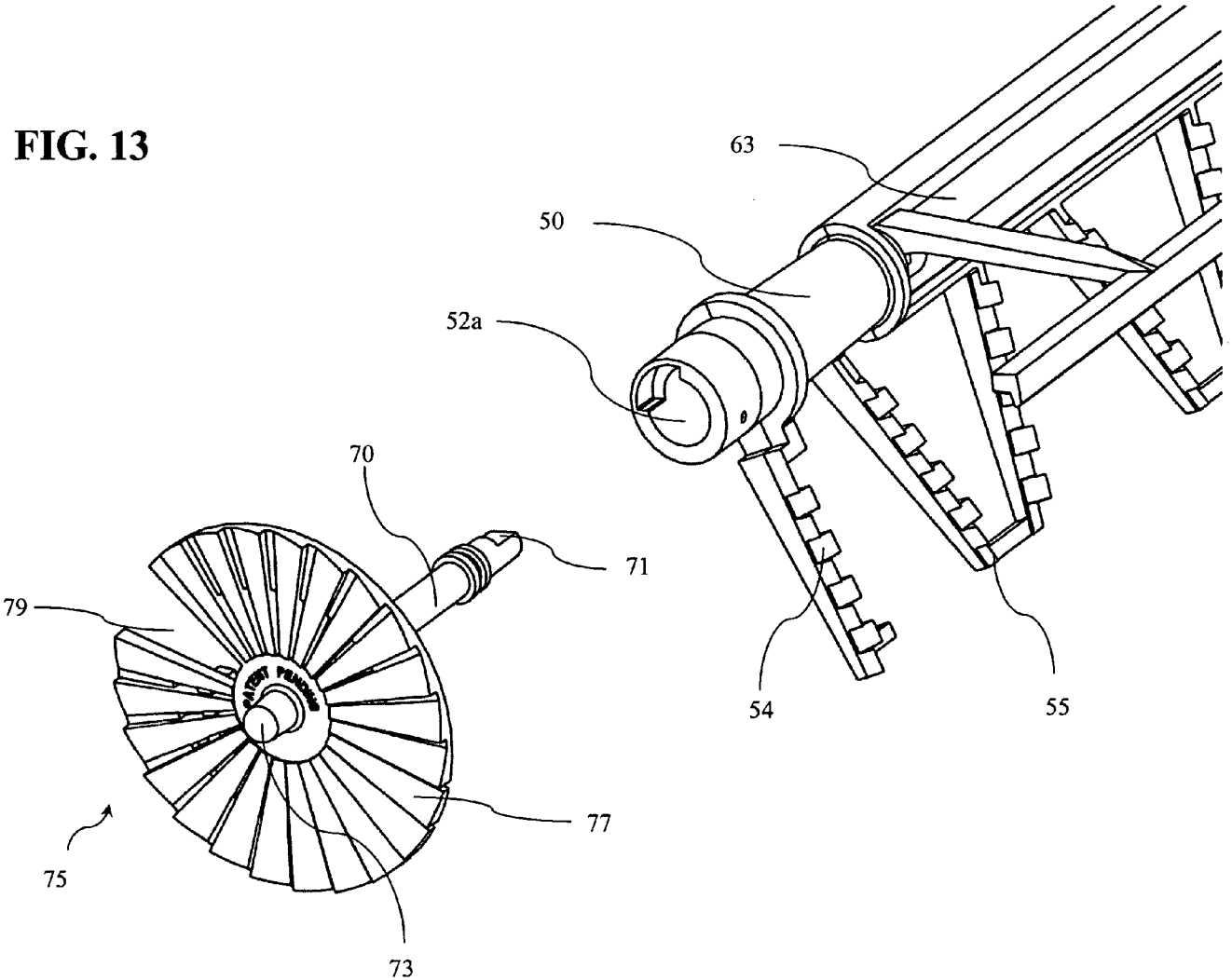
FIG. 13 is an exploded perspective view of the encoder disk and primary shaft.

FIG. 13 offers an alternative view of how encoder axle 70 fits within the hollow end 52*a* of primary shaft 50. Contact surface 71 extends to sensing device shaft 33, after passing through the hollow end 52*a* of primary shaft 50. FIG. 13 also depicts the outer surface of encoder disk 75, which contains a series of blades 77. As sensing device 60 is released from resistance (usually provided by the presence of toner), it springs forward due to the rotational force provided by biasing means 72. The increased rotation of encoder disk 75 causes blades 77 to channel air in a fan-like motion. The fan-like action of encoder disk 75 helps to "blow-clean" any toner or other particulate matter from the toner sensing mechanism.

Figure 17:
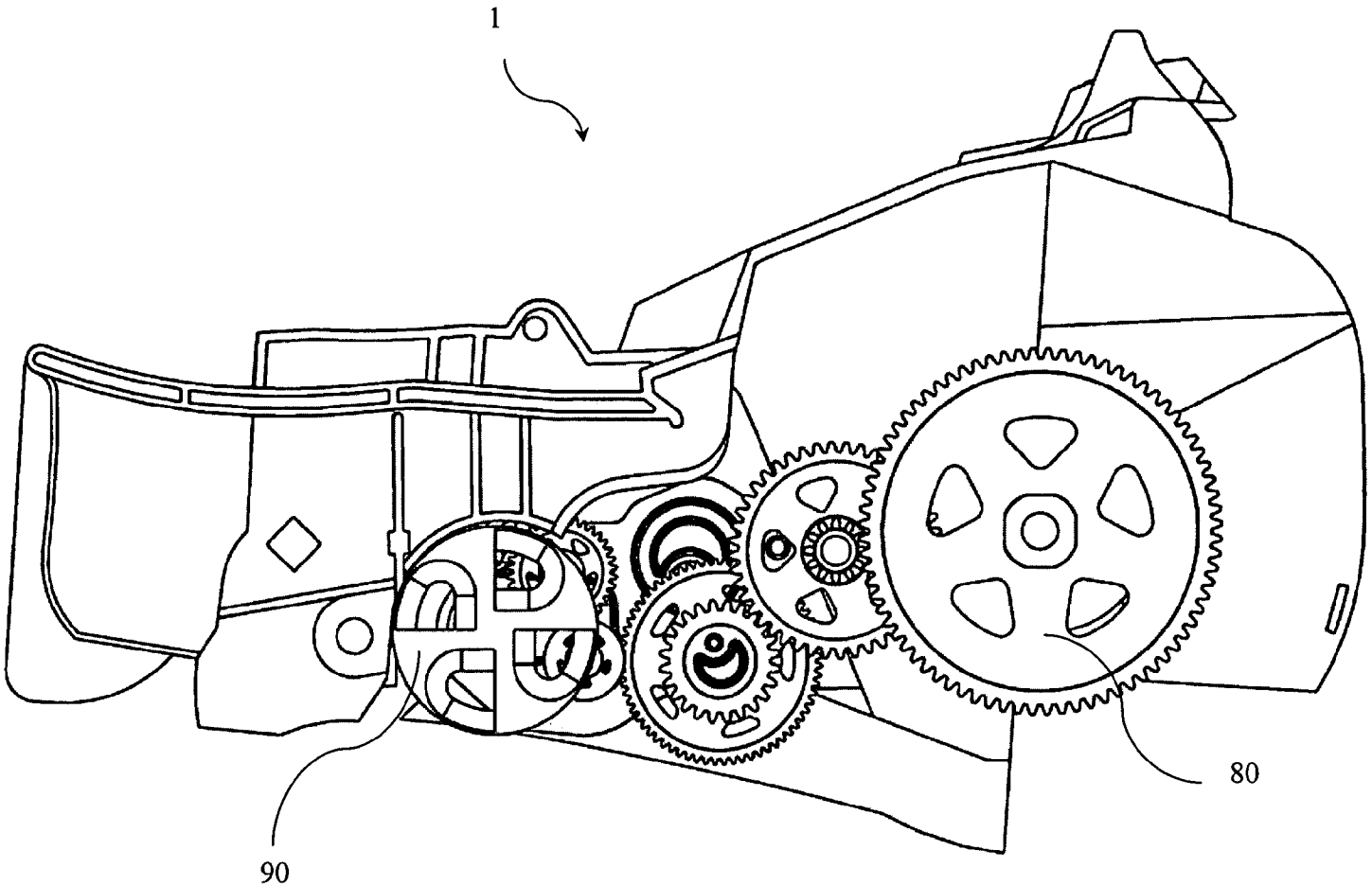
FIG. 17 is a side elevational view of the gear train of the novel toner cartridge showing.

Gear 80 provides the rotational force for primary shaft 50. Gear 80 engages the gear train of the toner cartridge (See FIG. 17) which connects to the drive means of the printer through drive dog gear 90. When a toner cartridge remains idle for a long period of time, as with storage, the toner inside can settle and become compacted. Accordingly, when the beater mechanism contacts the compacted toner, the shaft may stop when the drive gear does not. The drive gear can shear off the connecting end of primary shaft 50 causing catastrophic failure.

Figure 14:
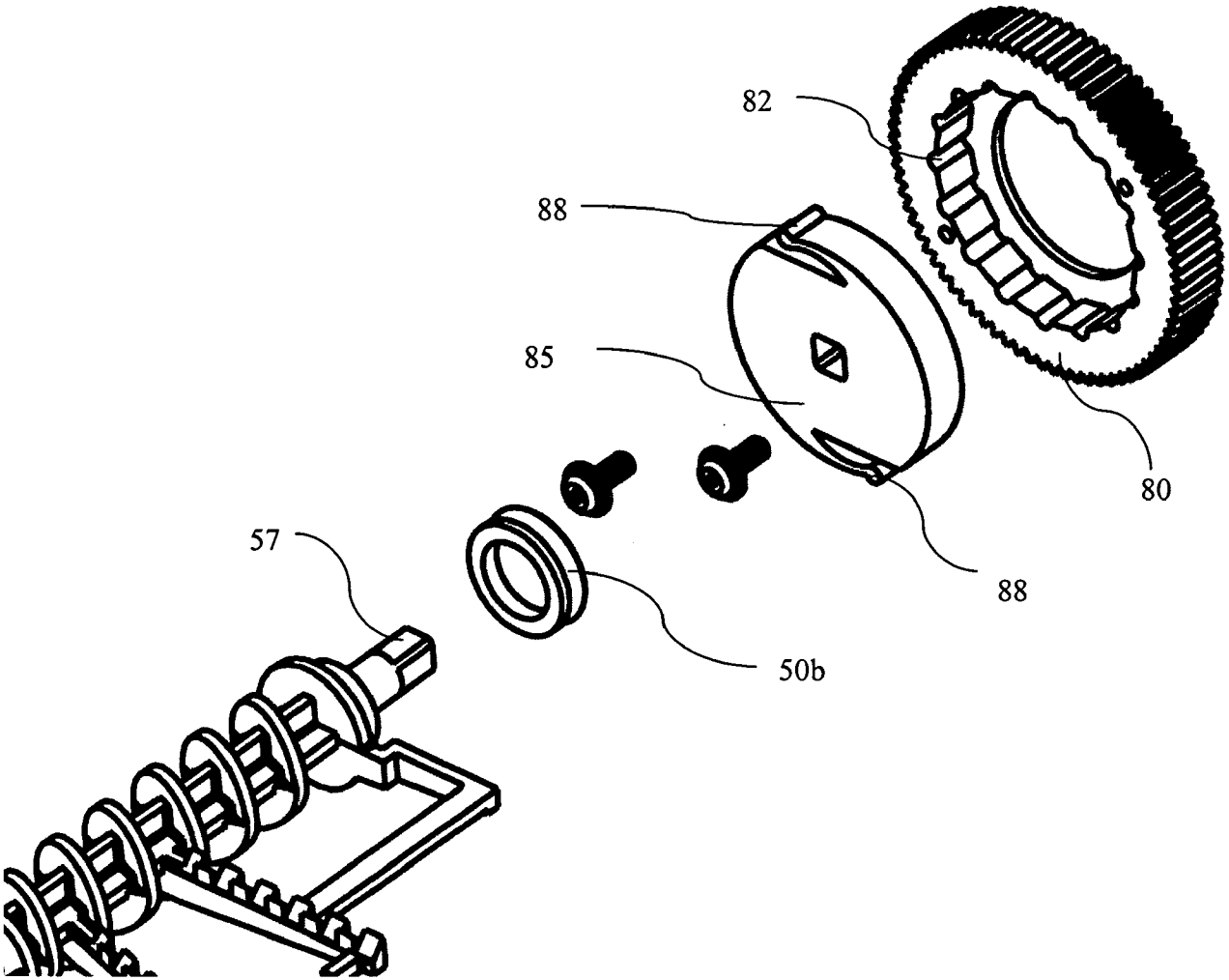
FIG. 14 is an exploded perspective view of the ratcheting gear.
Figure 15:
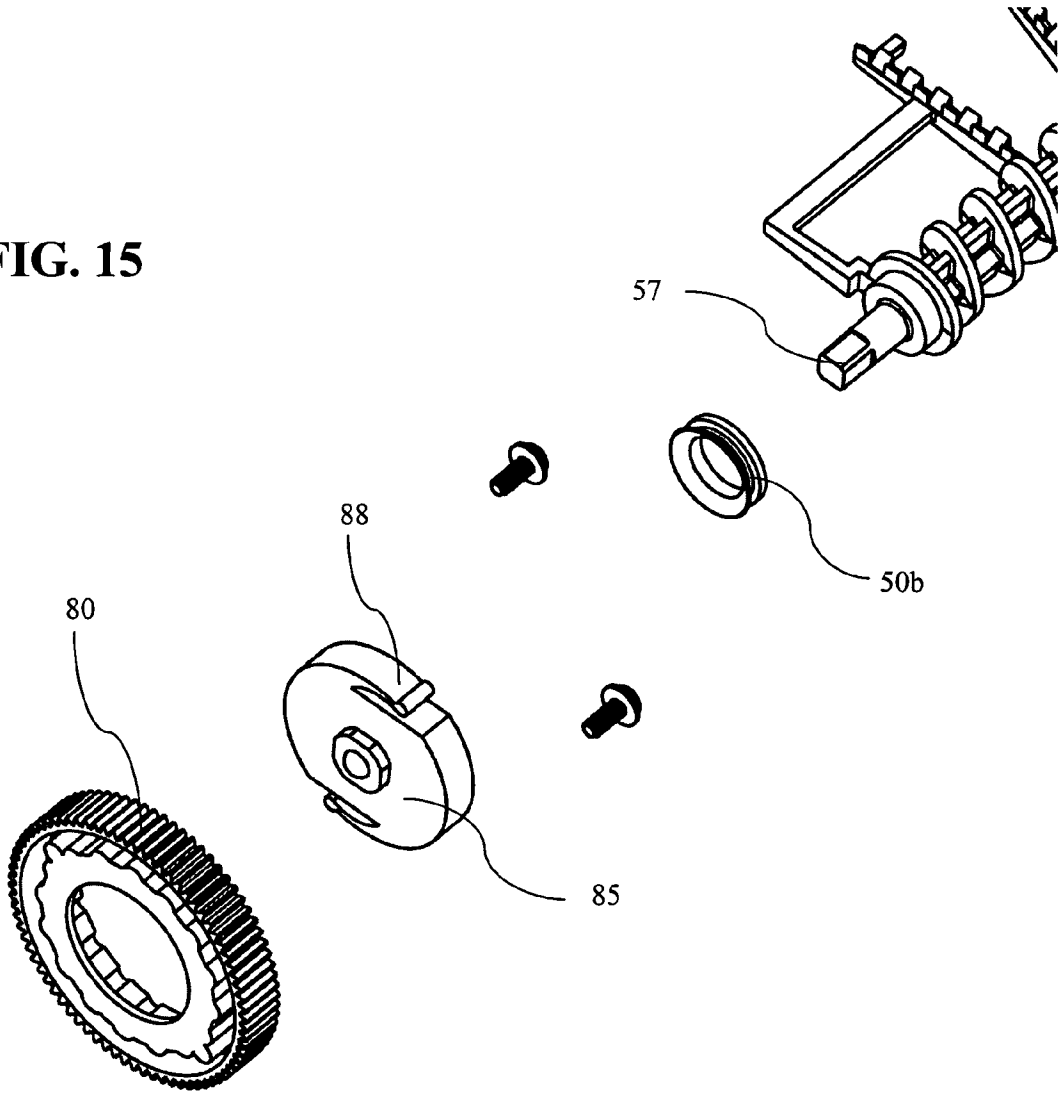
FIG. 15 is an exploded perspective view of the ratcheting gear.
Figure 16:
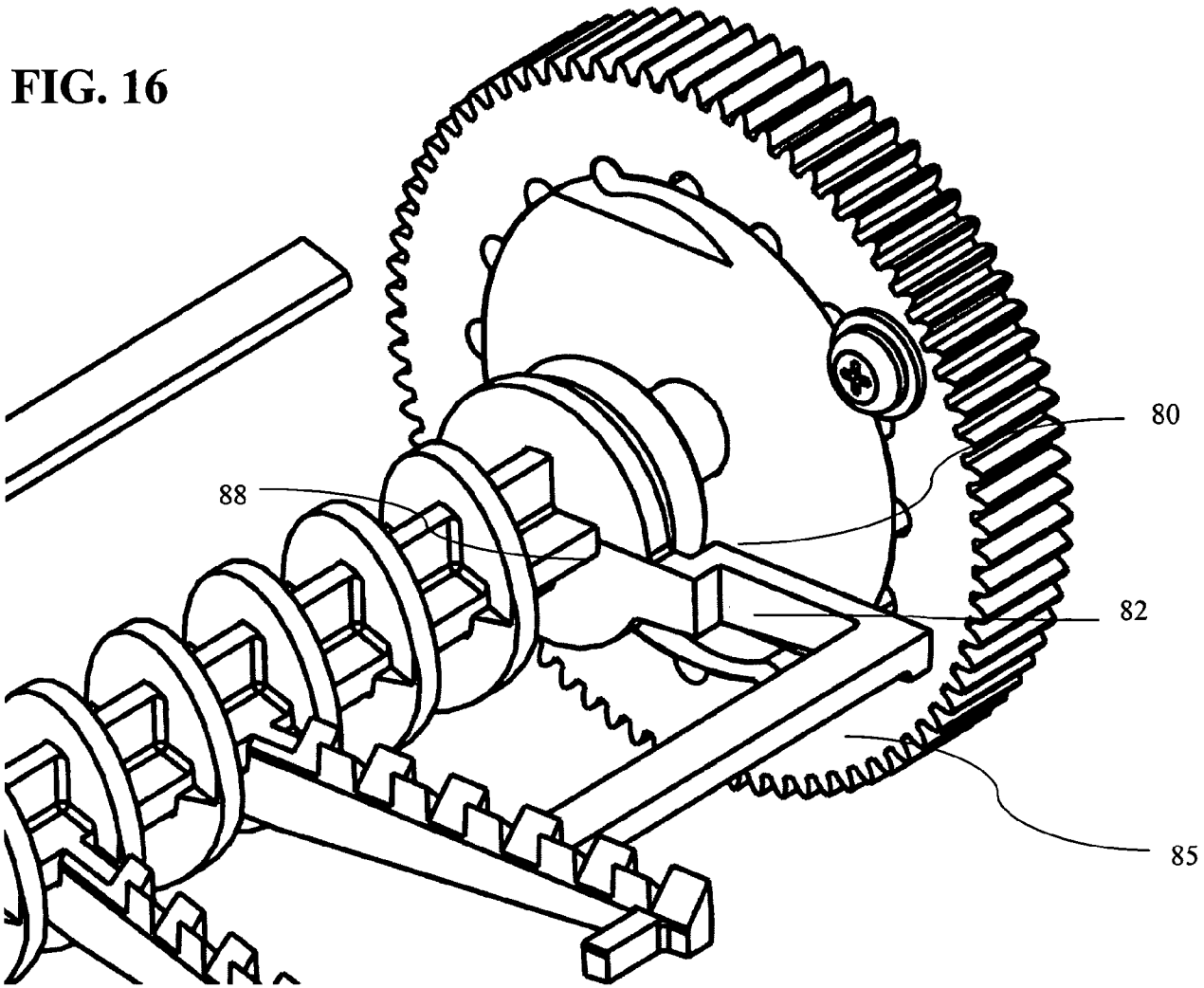
FIG. 16 is a perspective view of the assembled ratcheting gear.

In one embodiment, the beater assembly uses a ratcheting gear mechanism 80 (FIGS. 14–16), although a rigid gear drive is envisioned as well. The ratcheting gear assembly includes a ratcheting drive gear 80 with detent notches 82. Gear disk 85 bearing ratcheting pawls 88 is disposed within gear 80. When beater 40 contacts the compacted toner, ratcheting pawls 88 slip in ratcheting detents 82 of ratcheting gear 80. This prevents the shearing of the shaft experienced in the prior art. Every time gear disk 85 slips and engages gear 80, it drives the beater assembly through the toner slightly, as with a hammering movement. Ratcheting pawls 88 continue to slip within detents 82 until the beater assembly has been driven through the toner and thus softened it from its hardened state.

In an alternative embodiment, alternating teeth 54 on support members 55 add strength and rigidity to the support members. Teeth 54 enable support members to plow through compacted toner, or alternatively "chip away" the compacted toner through the ratcheting motion of the apparatus.

Operation of Sensing Apparatus

Figure 18B:
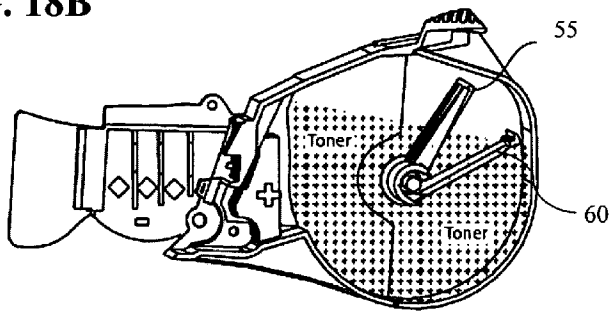
FIG. 18B is a perspective view of the operation of the sensing device and toner agitating mechanism wherein the sensing device has stopped in contact with the toner and the support members have continued their rotation.
Figure 18D:
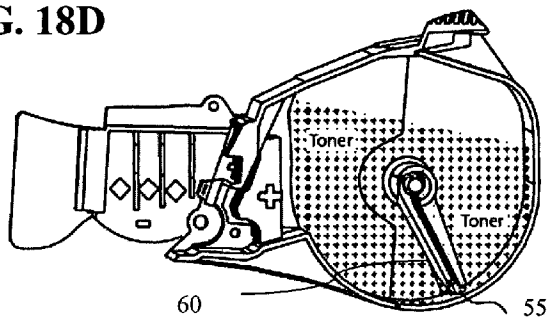
FIG. 18D is a perspective view of the operation of the sensing device and toner agitating mechanism wherein the support members have begun to drive the sensing device through the toner, thus agitating the toner.
Figure 18A:
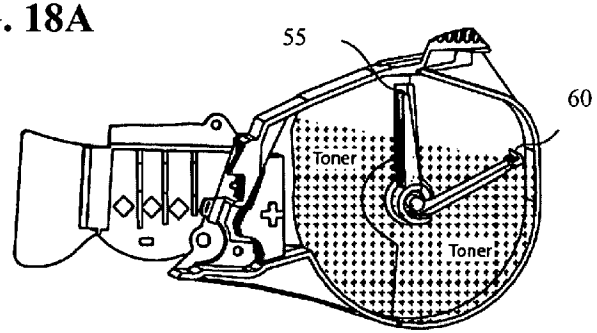
FIG. 18A is a perspective view of the operation of the sensing device and toner agitating mechanism wherein the sensing device has contacted the toner in leading relation to the support members.
Figure 18C:
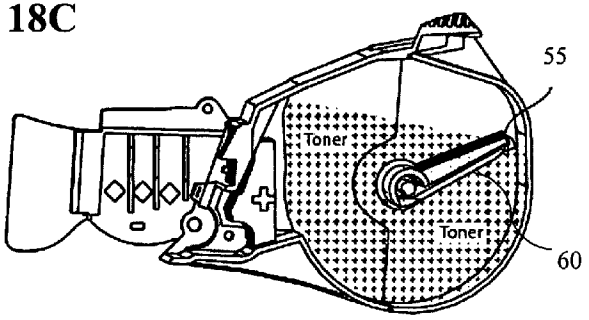
FIG. 18C is a perspective view of the operation of the sensing device and toner agitating mechanism wherein the support members have engaged the sensing device.
Figure 18E:
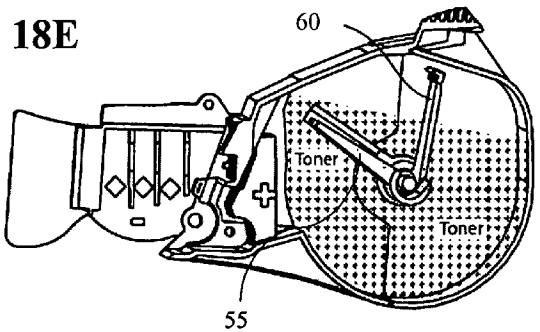
FIG. 18E is a perspective view of the operation of the sensing device and toner agitating mechanism wherein the sensing device has left the toner and sprung forward in leading relation to the support members.

During the operation of the apparatus (FIG. 18), toner sensing device 60 leads protruding support members 55 as primary shaft 50 and encoder axle 70 rotate (FIG. 18A). Sensing device 60 and support members 55 are not in contact as they move through the void of the toner container area above the body of toner. As the mechanism rotates through the toner chamber, sensing device 60 comes into contact with the toner where it stops (FIG. 18B) until support structures 55 of primary driving shaft 50 engage it (FIG. 18C) and drive it through the toner (FIG. 18D). When toner sensing device 60 emerges from the body of toner it springs forward and the cycle begins again (FIG. 18E). Through this operation, encoder axle 70 and encoder disk 75 communicate to the printer the level of toner contained within the total cartridge. Most printers employ a photo-optic system that determines the toner level by determining the location and timing measurements of voids within a timing disk (such as encoder disk 75) integral to the encoder axle. The printer determines the toner level by registering the point of contact where the toner level sensing device meets with the toner.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. A toner beater and sensing device for use in a toner cartridge having a toner chamber, comprising:

a primary shaft rotatable in the toner chamber;

an encoder disk disposed at one end of the primary shaft;

a sensing device pivotally connected to the primary shaft such that the sensing device rotates within the toner chamber coincident with the rotation of the encoder disk; and a gear disposed at one end of the primary shaft such that rotation of the gear causes the primary shaft to rotate within the toner chamber.

2. The toner beater and sensing device of claim 1 further comprising at least one support member protruding radially from the primary shaft, such that the sensing device rotates within the toner chamber in the same path of travel as, and in leading relation to the at least one support member.

3. The toner beater and sensing device of claim 1 further comprising a biasing means connecting the encoder disk and to the primary shaft such that the sensing device is selectively forced to the forward extent of its pivotal motion, when no resistance is exerted upon thereon.

4. The toner beater and sensing device of claim 1 further comprising: a spiral support material disposed along a portion of the primary shaft such that toner is urged from the perimeter of the toner chamber toward the center of the chamber.

5. The toner beater and sensing device of claim 1 further comprising: said encoder disk further including at least one indicia capable of detection by a printer such that detection thereof indicates a level of toner in the toner chamber.

6. The toner beater and sensing device of claim 1 further comprising: said encoder disk further including a plurality of blades across its outer surface such that rotation of the encoder disk causes particulate matter to be blown away from the encoder disk.

7. The toner beater and sensing device of claim 1 further comprising: said gear being a ratcheting gear connected to the primary shaft.

8. The toner beater and sensing device of claim 7 further comprising: said ratcheting gear including;

a plurality of ratcheting detents radially oriented within the inner surface of the ratcheting gear; and a gear disk rotatably disposed within the ratcheting gear, equipped with a plurality of pawls adapted to be received by the detents of the ratcheting gear such that the ratcheting gear will rotate about the gear disk when the resistance on the primary shaft exceeds the force applied by the rotation of the ratcheting gear.

9. A method of sensing the amount of toner in a toner cartridge having a toner chamber comprising the steps of:

providing a primary shaft rotatable in the toner chamber;

providing an encoder disk disposed at one end of the primary shaft;

providing a sensing device pivotally connected to the primary shaft such that the sensing device rotates within the toner chamber coincident with the rotation of the encoder disk; and establishing a number of indicia on the encoder disk capable of being detected by a light source within the printer.

* * * * *

UNITED STATES PATENT AND TRADEMARK OFFICE

CERTIFICATE OF CORRECTION

PATENT NO. : 7,177,567 B2
APPLICATION NO. : 10/907470
DATED : February 13, 2007
INVENTOR(S) : Steven Miller It is certified that error appears in the above-identified patent and that said Letters Patent is hereby corrected as shown below:

On patent cover page item (60) under Related U.S. Application Data, Line 1, after "Continuation", insert -- in part --

In Specification, Column 1, Line 9, replace "co-pending" with -- is a continuation in part of --

Signed and Sealed this

Seventeenth Day of August, 2010

David J. Kappos

David J. Kappos
*Director of the United States Patent and Trademark Office*